US006769909B2

(12) United States Patent
Schwartz

(10) Patent No.: US 6,769,909 B2
(45) Date of Patent: Aug. 3, 2004

(54) PAINT BAKING OVEN WITH RADIANT TUBE HEATING ELEMENTS AND METHOD OF USING SAME

(75) Inventor: Glen N Schwartz, Warren, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/273,686

(22) Filed: Oct. 19, 2002

(65) Prior Publication Data

US 2004/0076919 A1 Apr. 22, 2004

(51) Int. Cl.[7] ..... F27B 9/00
(52) U.S. Cl. ..... 432/175; 432/147; 34/270
(58) Field of Search ..... 432/136, 143, 432/147–148, 175; 34/215, 216, 267, 270, 266

(56) References Cited

U.S. PATENT DOCUMENTS

| | | | | | |
|---|---|---|---|---|---|
| 4,493,641 | A | * | 1/1985 | Hubbert | 432/120 |
| 4,546,553 | A | | 10/1985 | Best | 34/39 |
| 4,733,481 | A | * | 3/1988 | Hubbert | 34/666 |
| 4,761,894 | A | * | 8/1988 | Hamasaki et al. | 34/270 |
| 4,785,552 | A | * | 11/1988 | Best | 34/418 |
| 4,801,262 | A | * | 1/1989 | Johnson et al. | 432/8 |
| 5,230,161 | A | | 7/1993 | Best | 34/1 X |
| 5,568,692 | A | | 10/1996 | Crompton et al. | 34/270 |
| 5,588,830 | A | | 12/1996 | Josefsson et al. | 432/147 |
| 5,695,330 | A | | 12/1997 | Epworth | 432/148 |
| 5,836,085 | A | * | 11/1998 | Ben-Ezra | 34/270 |
| 6,062,850 | A | * | 5/2000 | Ino et al. | 432/143 |

* cited by examiner

*Primary Examiner*—Gregory Wilson
(74) *Attorney, Agent, or Firm*—Laura C. Hargitt

(57) ABSTRACT

An apparatus for curing paint on a surface of a vehicle body includes an oven enclosure having an oven section for receiving the vehicle body. A plurality of radiant tube heating elements is disposed in the oven section and each of the radiant heating tube elements has an exterior surface. An oven heater includes at least one burner disposed therein and is positioned external to the oven section. The oven heater is connected to the heating elements for providing heat energy to the oven section. A control means is connected to the oven heater for turning the oven burner on and off to maintain a predetermined temperature at the exterior surfaces of the heating elements whereby uncured paint on a surface of a vehicle body in the oven section is cured.

10 Claims, 3 Drawing Sheets

PAINT BAKING OVEN WITH RADIANT TUBE HEATING ELEMENTS AND METHOD OF USING SAME

BACKGROUND OF THE INVENTION

The present invention relates generally to paint baking ovens for use in the automotive industry and, in particular, to a paint baking oven with radiant tube heating elements.

Paint baking ovens, especially in the automotive industry, are well known. Paint baking ovens are utilized to cure the surface of a freshly painted product, such as an automobile body, in an enclosed, dust free environment. A typical prior art paint baking oven is constructed of an insulated enclosure that is heated and through which the painted vehicles are conveyed. Prior art ovens typically have two sections, a first or "bring up" section, and a second or "hold" section. Each section of the oven may have several zones. The first section of the prior art oven uses a flat panel or curved panels that are heated from behind the panels to provide radiant heat to heat the vehicle in a calm, dust free atmosphere. The second section of the prior art oven uses convection to maintain the cure temperature for a predetermined cure time. Each zone of a conventional oven uses a large exterior heater to supply the heat for curing the paint. In addition, heated fresh air is introduced into the oven for safety ventilation of the fumes released during the curing process. The heater is an insulated box having a gas-fired burner and fans disposed therein to recirculate the air via conduits or ducts in the oven. The heater can be of a direct fired or indirect fired type and may or may not include filters, depending on the type of application. The gas-fired burners of the prior art are known as modulating burners that cycle from high fire to low fire, and vary the amount of fuel to the burner to increase or decrease the temperature supplied to the oven zones.

The instrumentation utilized for measuring the cure temperature on the vehicle surface has improved over the years and can now measure multiple points within the oven body. The temperature data recorded from prior art paint baking ovens indicates that the conventional prior art paint baking ovens do not provide a uniform cure temperature.

Radiant tube heaters are a well known type of heater used in paint baking ovens. Radiant tube heaters typically include an inlet and an outlet and a reflector member attached at an outer periphery thereof for directing the radiant heat in a desired direction. Combustion products are introduced at the inlet and flow toward the outlet, transferring heat to the walls of the tube while flowing from the inlet toward the outlet. The walls of the tube then emit radiant heat to the interior of the oven body. Radiant tube heaters, however, have been used only for providing supplemental heat for the vehicle body rocker panels in prior art automotive paint bake ovens. The prior art radiant tube heaters disadvantageously provided poor temperature control and tended to overheat the thinner metal on the vehicle in part because the prior art radiant tube heaters required the burners to be mounted adjacent to the tube. The radiant tube heaters were limited in length because of the tube being straight and because of the difficulty of mounting burner components inside the oven enclosure. Due to their limited length, radiant tube heaters have only been used in the initial portion of the bring-up section in prior art paint baking ovens.

Radiant tube heaters, however, have been used in other applications such as heat treating furnaces where the temperature over the length of the tube was not difficult to control because of the higher temperatures at which the furnace operates. Radiant tube heaters are advantageous for indirect heat because they operate using less excess combustion air, and therefore use less energy while providing the same or greater amount of heat to the oven.

It is desirable, therefore, to provide a paint baking oven having uniform cure temperatures throughout the length of the oven. It is also desirable to provide a more efficient paint baking oven utilizing radiant tubes heaters as a heat source throughout the entire length of the oven.

SUMMARY OF THE INVENTION

The present invention concerns an apparatus for curing paint on a surface of a vehicle body. The apparatus includes an oven enclosure having an oven section for receiving the vehicle body. A plurality of radiant tube heating elements is disposed in the oven section and each of the radiant heating tube elements has an exterior surface. An oven heater includes at least one burner disposed therein and is positioned external to the oven section. The oven heater is connected to the heating elements for providing heat energy to the oven section. A control means is connected to the oven heater for turning the oven burner on and off to maintain a predetermined temperature at the exterior surfaces of the heating elements whereby uncured paint on a surface of a vehicle body in the oven section is cured.

The paint baking oven according to the present invention uses at least one radiant tube heater that is heated with a pulse-fired gas burner to provide a uniform surface temperature on the radiant tube. The timing of the pulse-fired gas burner is controlled by the control means, which monitors the surface temperature of the radiant tube. When the surface temperature of the radiant tube drops below a predetermined value, the burner is ignited and when the surface temperature of the radiant tube exceeds another predetermined value, the burner is extinguished. A continuous spark in the gas burner is used to ignite the gas and air mixture. The gas and air is then mixed with a small portion of excess air, allowing the combustion of the gas and air mixture at near stoichiometric conditions. The radiant tube heaters are preferably constructed of standard materials and will be used to transfer heat to vehicles with wet paint that is to be cured. The burner is advantageously mounted external to the oven enclosure, which allows the use of radiant tube heaters throughout the entire length of the oven.

The paint baking oven according to the present invention includes a "bring up" section, a "temperature stabilization" section, and a "hold" section. Each of the sections includes a plurality of zones therein. The vehicle body having a coat of fresh paint is introduced into the "bring up" section and later moves to the "temperature stablization" section and finally to the "hold" section. The vehicle body is conveyed through the oven by a conveyor or the like and remains in each zone for a predetermined time interval.

The paint baking oven according to the present invention advantageously does not require the large exterior heater for heating recirculated air used on prior art conventional ovens but does utilize the heater for heating ventilation air. The present invention also does not require flame supervision or recirculation air filters as in the prior art. The present invention includes a paint baking method that provides a uniform cure temperature and a paint baking oven that can be installed with less capital cost and can operate with less energy than prior art paint baking ovens, thereby reducing operation cost. The present invention also provides an oven that has a straightforward design and is easy to operate and occupies less vertical space than a conventional prior art oven.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
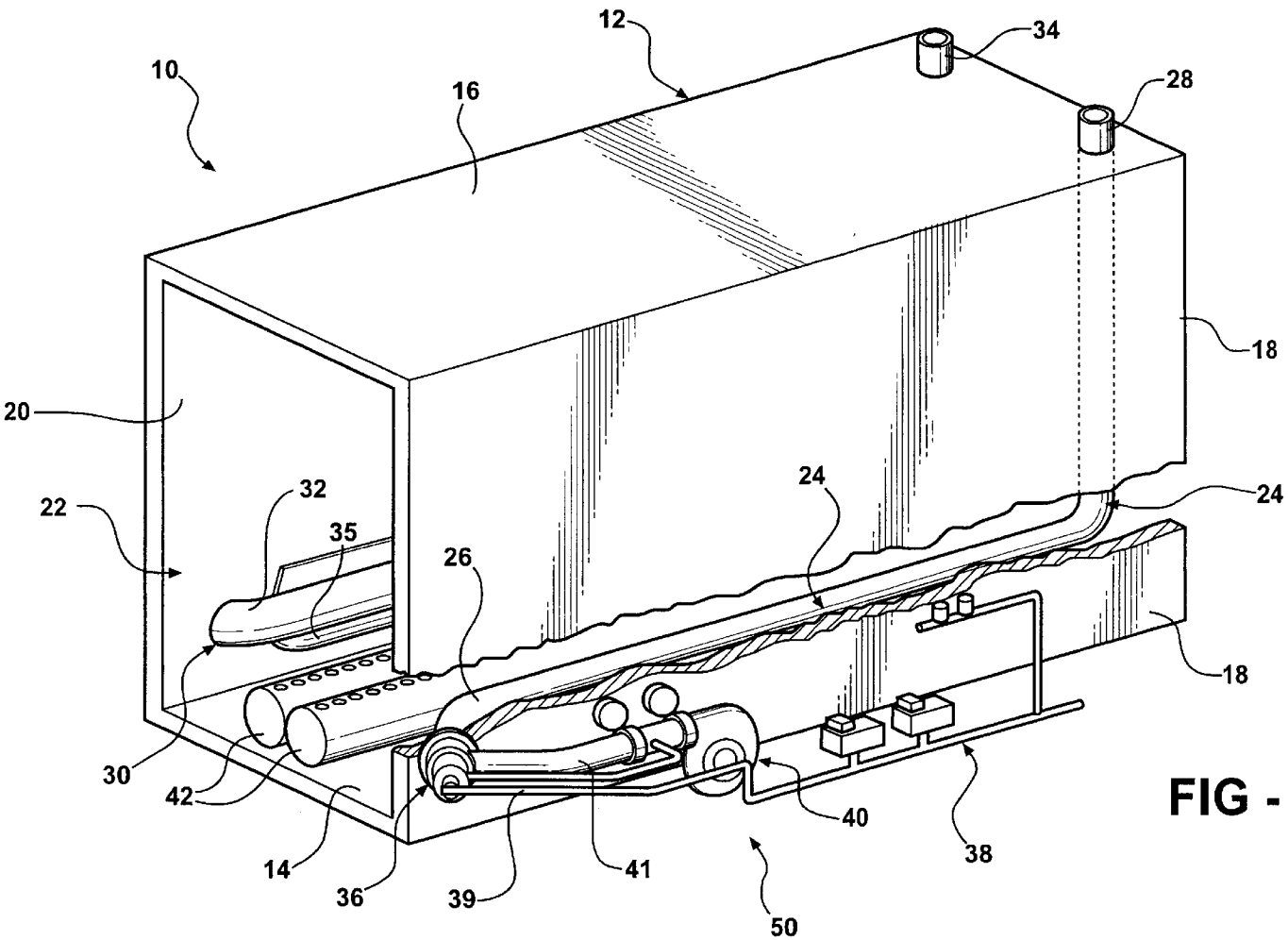
FIG. 1 is a perspective view of a zone of a paint baking oven in accordance with the present invention.

Referring now to FIG. 1, a zone of a paint baking oven (not shown) in accordance with the present invention is indicated generally at 10. The oven zone 10 is preferably a part of a section (not shown) of the oven. The oven preferably includes a plurality of zones, such as the zone 10, in a plurality of sections throughout the length of the oven. The zone 10 includes an oven enclosure or body 12 having a lower wall 14, an upper wall 16, a first side wall 18 and a second side wall 20. The walls 14, 16, 18, and 20 define an oven interior 22.

A first radiant heating element or tube heater 24 having an inlet 26 and an outlet 28 is disposed in the oven interior 22 adjacent the first side wall 18. A second radiant heating element or tube heater 30 having an inlet 32 and an outlet 34 is disposed in the oven interior 22 adjacent the second side wall 20. Each radiant tube heater 24 and 30 includes a reflector member 35, best seen adjacent the second radiant tube heater 30, attached at an outer periphery thereof for directing the radiant heat towards a middle portion of the oven interior 22. The radiant tube heaters 24 and 30 are preferably constructed of steel or similar material and the exterior surfaces of the radiant tube heaters 24 and 30 are preferably bare, uncoated metal.

A burner 36 is attached to the inlet 26 of the first radiant tube heater 24. Preferably, the burner 36 is a pulse-fired burner. A fuel train 38, connected to a fuel source (not shown), supplies fuel through a fuel conduit 39 to the burner 36. A blower 40 supplies air through an air conduit 41 to the burner 36. Another burner 36 (not shown) having a fuel train (not shown) and a blower (not shown) attached thereto is attached to the inlet 32 of the second radiant tube heater 30. The burner 36 produces hot combustion products to provide a heat source for the tube heaters 24 and 30. The burner 36, the fuel train 38, the fuel conduit 39, the blower 40, and the air conduit 41, in combination, form an oven heater or heat source, indicated generally at 50. A plurality of supply conduits 42 are connected to a supply of heated fresh air (not shown) and supply heated fresh air to the oven interior 22 during operation of the paint baking oven, outlined in more detail below.

Figure 2:
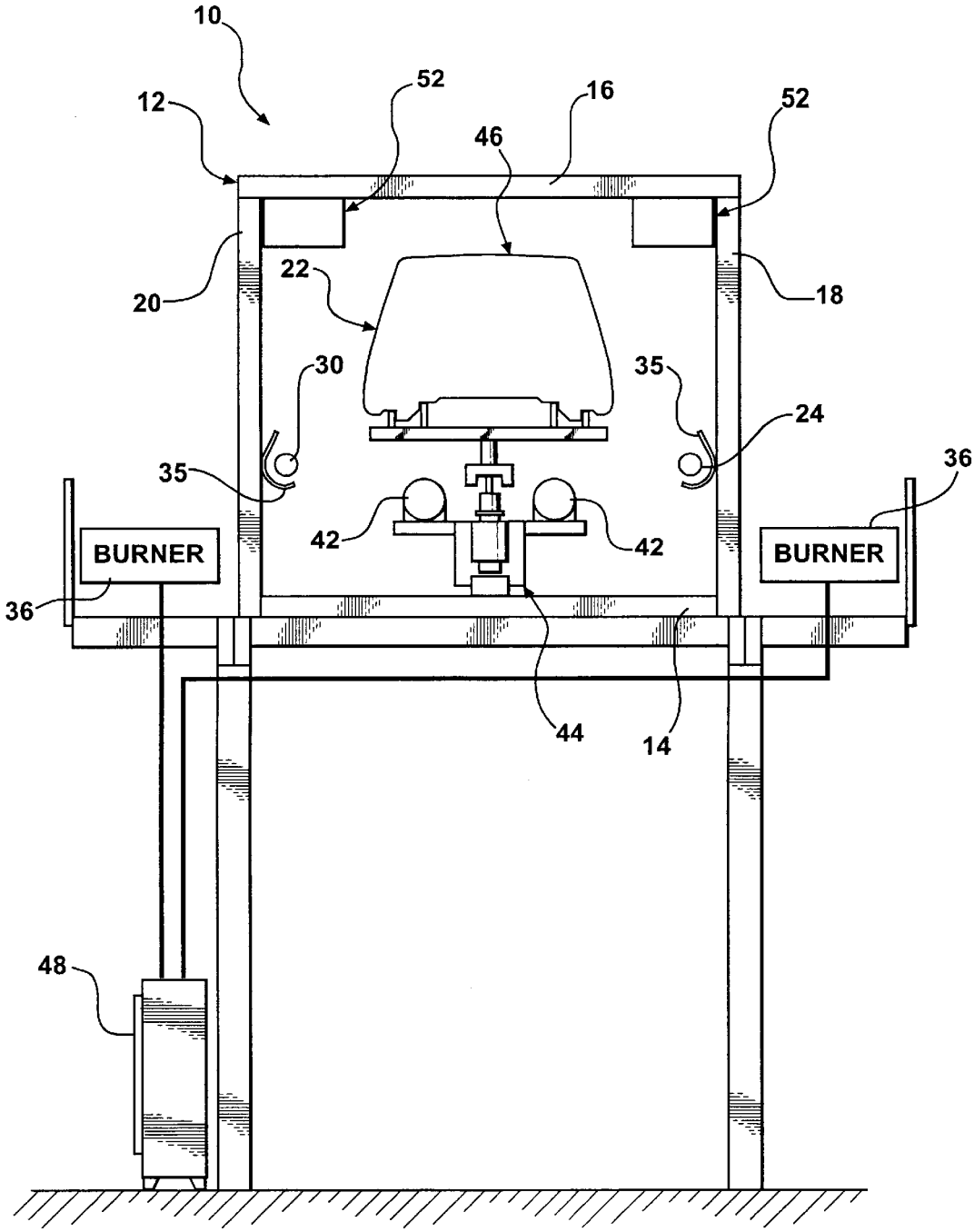
FIG. 2 is cross-sectional view of the zone of the paint baking oven in FIG. 1.

Referring now to FIG. 2, a cross section of the zone 10 of the paint baking oven of FIG. 1 is shown. The first 24 and the second 30 radiant tube heaters and the supply conduits 42 are shown in the oven interior 22. The burners 36 are shown adjacent the first side wall 18 and the second side wall 20. A conveyor 44 is disposed in the oven interior 22 adjacent the lower wall 14 and the supply conduits 42. A vehicle body 46 is attached to an upper portion of the conveyor 44. A control means or controller 48, such as an oven control panel or the like, controls the burner 36, which is operable to supply heat to the first 24 and the second 30 radiant tube heaters during operation of the oven, outlined in more detail below. A plurality of exhaust ducts 52 is disposed adjacent the upper wall 16 of the oven body 12. The exhaust ducts 52 are connected to exhaust fans (not shown) for removing air and paint solvents from the oven interior 22 during operation of the oven, outlined in more detail below.

Figure 3:
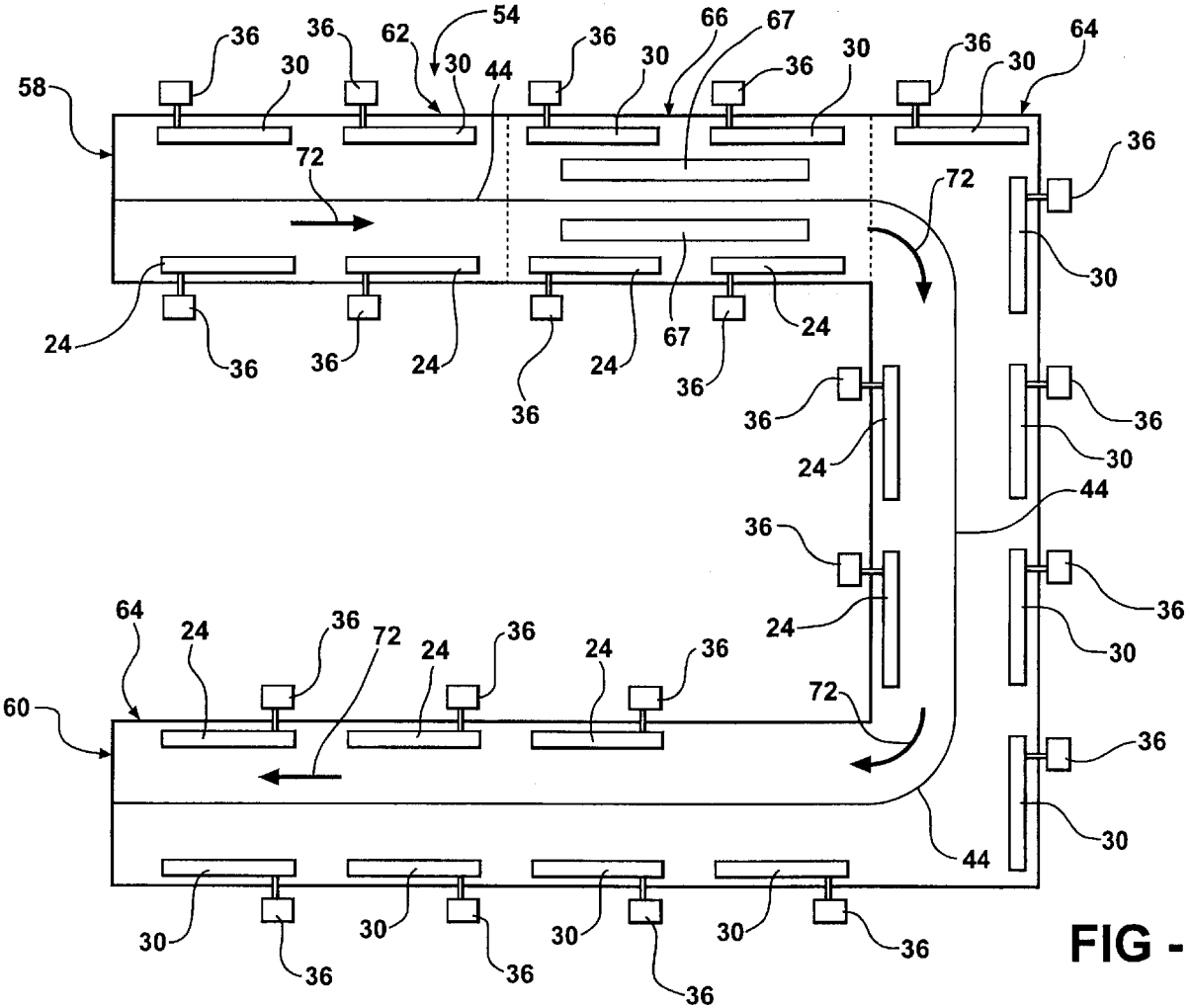
FIG. 3 is a schematic view of a paint baking oven in accordance with the present invention depicting the various sections of the oven.

Referring now to FIG. 3, a paint oven in accordance with the present invention is indicated generally at 54 in schematic view. The oven 54 includes the conveyor 44 disposed therein. The conveyor 44 extends throughout the length of the oven 54 from an entrance portion 58 to an exit portion 60 of the oven 54. The entrance portion 58 and the exit portion 60 are adapted to seal the oven interior 22 during operation of the oven 54. The conveyor 44 is operable to move a vehicle body, such as the vehicle body 46 of FIG. 2, from the entrance portion 58 to the exit portion 60 of the oven 54. The paint oven 54 includes a "bring up" section 62 adjacent the entrance portion 58, a "hold" section 64 adjacent the exit portion 60, and a "temperature stabilization" section 66 intermediate the bring up section 62 and the hold section 64. The temperature stabilization section 66 is a convection section having a high air turn over rate (twice as high as a normal convection zone) with the air directed at an upper and a lower portion of the vehicle body 46. Each section 62, 64, and 66 includes a plurality of zones (not shown), such as the zone 10 of FIGS. 1 and 2, disposed therein. Each zone includes a plurality of radiant heating elements or tube heaters, such as the radiant tube heaters 24 and 30 of FIGS. 1 and 2, disposed therein. Each of the radiant tube heaters 24 and 30 includes a reflector (not shown) attached thereto. Each of the radiant tube heaters 24 and 30 are connected to a burner, such as the pulse-fired burner 36 of FIGS. 1 and 2. The oven 54, therefore, has radiant heating element or tube heaters 24 and 30 extending throughout the length thereof. The temperature stabilization section 66 includes at least one convection air duct 67 disposed therein for directing heated air at the upper and the lower portion of the vehicle body 46.

Referring now to all of the Figures, in operation, a vehicle body, such as the vehicle body 46 of FIG. 2, having a fresh coat of paint (not shown) applied to an exterior surface (not shown) thereof is attached to the conveyor 44 and introduced into the entrance portion 58 of the oven 54. The entrance portion 58 and the exit portion 60 are sealed and the vehicle body 46 is moved through the oven 54 in a curing direction indicated by an arrow 72.

The controller 48 begins turning the burners 36 of the oven heater 50 on and off to heat the oven interior 22. The combustion products (not shown) from the burners 36 enter the tube heaters 24 and 30 at their respective first ends 26 and 32 and exit through their respective second ends 28 and 34, transferring heat to the walls of the tube heaters 24 and 30 while flowing from the first ends 26 and 32 toward the second ends 28 and 34. The uncoated, bare metal outer surfaces of the tube heaters 24 and 30 emit radiant heat therefrom to heat the oven interior 22. The controller 48 turns the burners 36 on and off to reach a predetermined temperature in each of the sections 62, 64, and 66. The predetermined temperature in each section 62, 64, and 66 is based on the surface material of the vehicle body 46 being cured as well as the type of paint applied to the vehicle body surface.

A separate controller (not shown) controls the operation of the conveyor 44 to move the vehicle body 46 in order that the vehicle body 46 remains in each section 62, 64, and 66 for a predetermined time interval. The controller 48 monitors the surface temperature of the radiant tube heaters 24 and 30 and starts and stops the burners 36 in order to maintain a predetermined temperature on the surface of the radiant tube heaters 24 and 30. Maintaining a predetermined temperature on the surface of the radiant tube heaters 24 and 30 allows the controller to maintain a predetermined temperature in each of the respective zone 62, 64, and 66.

As the vehicle body 46 moves through the oven 54, the temperature in the oven interior 22 begins to cure the paint on the vehicle body surface, which generates curing products (not shown). The curing products are removed from the oven interior 22 through the exhaust ducts 52, aided by the, heated air supply conduits 42. The heated supply air is preferably directed at the lower portion of the vehicle body 46 to prevent the vehicle body surface from overheating.

The controller 48 continues to monitor the temperature of the surface of the radiant tube heaters 24 and 30, the temperature in each of the respective zone 62, 64, and 66, and the location of the vehicle body 46 along the conveyor 44 in order to maintain the proper temperatures and times to cure the paint on the vehicle surface properly. Typically, each predetermined temperature is maintained by turning on the burners when the monitored temperature is below a lower temperature value and turning off the burners when the monitored temperature is above an upper temperature value, the lower and upper values defining a temperature range that includes the predetermined temperature.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for curing paint on a surface of a vehicle body comprising:

an oven enclosure having a "bring up" section, a "temperature stabilization" section, and a "hold" section for receiving a vehicle body;

a plurality of radiant tube heating elements disposed in at least two of said oven sections, said heating elements each having an exterior surface;

an oven heater having at least one burner, said oven heater being positioned external to said oven sections and connected to said heating elements for providing heat energy to said oven sections;

a reflector member attached at an outer periphery of each of said radiant tube heating elements; and control means connected to said oven heater for turning said at least one burner on and off to maintain a predetermined temperature at said exterior surfaces of said heating elements whereby uncured paint on a surface of the vehicle body in said at least one oven section is cured.

2. The apparatus according to claim 1 wherein said exterior surfaces of said radiant tube heating elements are uncoated bare metal material.

3. An apparatus for curing paint on the surface of a vehicle body, said apparatus comprising:

a hollow paint oven body having an interior portion for receiving a vehicle body, said interior portion of said oven body including a "bring up" section, a "temperature stabilization" section, and a "hold" section along the entire length thereof;

a plurality of radiant tube heating elements disposed in said sections of said interior portion of said paint oven body, said radiant tube heating elements each having an exterior surface;

a reflector member attached at an outer periphery of each of said radiant tube heating elements; and an oven heater having at least one burner, said oven heater being positioned external to said oven body and including at least one conduit extending from said oven heater into said interior portion of said oven body and to said radiant tube heating elements, whereby said at least one burner is turned on and off and supplies heat to said radiant tube heating elements via said at least one conduit when said exterior surfaces of said radiant tube heating elements drop below a predetermined temperature, and said radiant tube heating elements transfer heat to said interior portion of said paint oven body for curing uncured paint on a surface of the vehicle body in said interior portion of said oven body.

4. The apparatus according to claim 3 including a controller, said controller operable to monitor the temperatures of said exterior surfaces of said radiant tube heating elements and to control said at least one burner.

5. The apparatus according to claim 3 wherein said exterior surfaces of said radiant tube heating elements are uncoated bare metal material.

6. A method for curing paint on a surface of a vehicle body utilizing a paint oven, an oven heater, and a control means, the paint oven having an entrance portion, an exit portion, and a plurality of radiant tube heating elements each having exterior surfaces disposed in an oven section, the oven heater having a burner disposed therein, the burner connected to the radiant tube heating elements, the control means connected to the oven heater and operable to control the burner, said method comprising the steps of:

a) introducing a vehicle body into the paint oven;

b) sealing the entrance portion and the exit portion of the paint oven;

c) conveying the vehicle body from the entrance portion to the exit portion of the paint oven;

d) monitoring the temperature on the exterior surface of the radiant tube heating elements;

e) firing the burner to reach a predetermined temperature on the exterior surface of the radiant tube heating elements;

f) stopping the burner once the monitored temperature on the exterior surface of the radiant tube heating elements reaches the predetermined temperature; and g) repeating steps e) and f) when the monitored temperature is below the predetermined temperature while the vehicle body is in the paint oven.

7. The method according to claim 6 wherein the predetermined temperature is a temperature range having an upper value and a lower value, said step e) is performed when the monitored temperature falls below the lower value and said step f) is performed when the monitored temperature exceeds the upper value.

8. An apparatus for curing paint on a surface of a vehicle body comprising:

an oven enclosure having a "bring up" section, a "temperature stabilization" section, and a "hold" section for receiving a vehicle body;

a plurality of radiant tube heating elements disposed in at least one of said sections, said heating elements each having an exterior surface;

an oven heater having at least one burner, said oven heater being positioned external to said oven sections and connected to said heating elements for providing heat energy to said oven sections; and control means connected to said oven heater for turning said at least one burner on and off to maintain a predetermined temperature at said exterior surfaces of said heating elements, whereby uncured paint on a surface of the vehicle body in said sections is cured.

9. An apparatus for curing paint on the surface of a vehicle body, said apparatus comprising:

a hollow paint oven body having an interior portion for receiving a vehicle body, said interior portion of said oven body including a plurality of contiguous sections along the entire length thereof, said contiguous sections including a "bring up" section, a "temperature stabilization" section, and a "hold" section;

a plurality of radiant tube heating elements disposed in said sections of said interior portion of said paint oven body, said radiant tube heating elements each having an exterior surface; and an oven heater having at least one burner, said oven heater being positioned external to said oven body and including at least one conduit extending from said oven heater into said interior portion of said oven body and to said radiant tube heating elements, whereby said at least one burner is turned on and off and supplies heat to said radiant tube heating elements via said at least one conduit when said exterior surfaces of said radiant tube heating elements drop below a predetermined temperature, and said radiant tube heating elements transfer heat to said interior portion of said paint oven body for curing uncured paint on a surface of the vehicle body in said interior portion of said oven body.

10. An apparatus for curing paint on the surface of a vehicle body, said apparatus comprising:

a hollow paint oven body having an interior portion for receiving a vehicle body, said interior portion of said oven body including a plurality of contiguous sections along the entire length thereof, said contiguous sections including a "bring up" section, a "temperature stabilization" section, and a "hold" section;

a plurality of supply conduits disposed in a lower portion of said sections of said interior portion of said paint oven body, said supply conduits connected to a supply of heated fresh air to supply heated fresh air to said oven interior portion of said paint oven body;

a plurality of single-pass radiant tube heating elements disposed in said sections of said interior portion of said paint oven body, said radiant tube heating elements each having an exterior surface;

an oven heater having at least one pulse-fired burner, said oven beater being positioned external to said oven body and including at least one conduit extending from said oven heater into said interior portion of said oven body and to said radiant tube heating elements; and control means connected to said oven heater for turning said at least one pulse-fired burner on and off to maintain a predetermined temperature at said exterior surfaces of said heating elements, whereby uncured paint on a surface of the vehicle body in said sections is cured.

* * * * *